United States Patent [19]

Golioto

[11] 4,016,385

[45] Apr. 5, 1977

[54] HIGH VOLTAGE TRANSFER SWITCH WITH CAM CONTROLLED OVERLAP DURING TRANSFER

[75] Inventor: Igor Golioto, Fairfield, N.J.

[73] Assignee: Bell Telephone Laboratories, Incorporated, Murray Hill, N.J.

[22] Filed: Oct. 8, 1975

[21] Appl. No.: 620,643

[52] U.S. Cl. ..... 200/153 L; 200/18; 200/144 B

[51] Int. Cl.[2] ..... H01H 3/42; H01H 33/66

[58] Field of Search ..... 200/11 TC, 17 R, 18, 200/144 B, 153 L, 153 LA, 153 LB, 153 P

[56] References Cited

UNITED STATES PATENTS

| | | | |
|---|---|---|---|
| 2,892,047 | 6/1959 | Smith | 200/38 |
| 3,066,208 | 11/1962 | Fannon, Jr. et al. | 200/11 TC |
| 3,307,005 | 2/1967 | Babb et al. | 200/153 L |
| 3,415,957 | 12/1968 | Bleibtreu et al. | 200/11 TC X |
| 3,532,842 | 10/1970 | Fohrhaltz | 200/144 B |
| 3,811,022 | 5/1974 | Guidosh | 200/153 L X |

*Primary Examiner*—James R. Scott
*Attorney, Agent, or Firm*—Alfred G. Steinmetz

[57] ABSTRACT

A transfer switch to selectively transfer an electrical load from one high voltage source to another includes a shaft connected to a handle. Spaced close to opposite ends of the shaft are two circular slotted cams. Cam followers connected to opposite ends of a follower bar are inserted in the cam slot. The follower bars connected to the cam followers are connected to vacuum interrupter contacts (mechanical vacuum relays). The transfer switch is constructed so that as the cam is rotated the contacts connecting one high voltage source to the electrical load are closed and as the cam is continued to be rotated the contactors of the previously connected high voltage supply are subsequently released.

7 Claims, 7 Drawing Figures

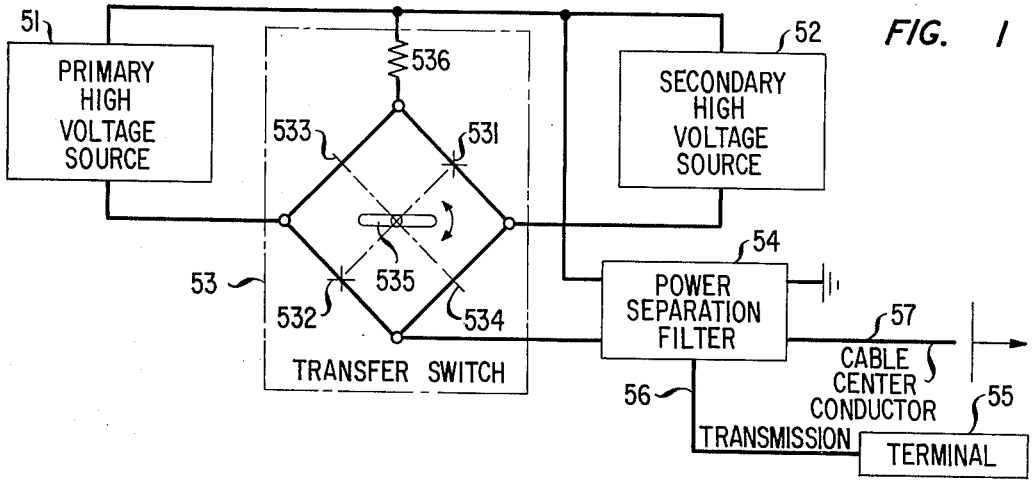
FIG. 1
FIG. 2
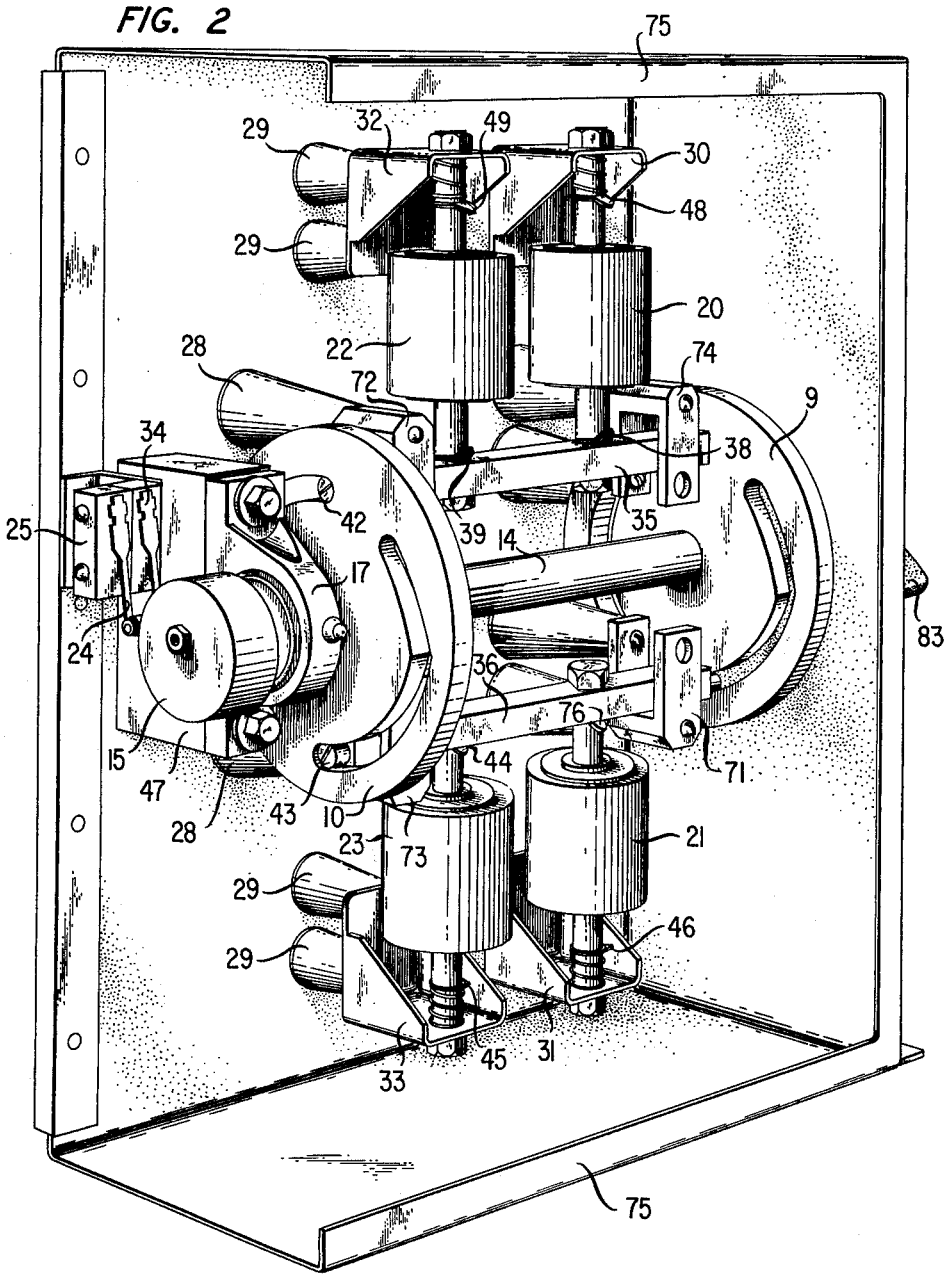

HIGH VOLTAGE TRANSFER SWITCH WITH CAM CONTROLLED OVERLAP DURING TRANSFER

BACKGROUND OF THE INVENTION

This invention is concerned with mechanical transfer switches to switch loads from one electrical source to another. It is specifically concerned with a power supply transfer switch designed to accommodate very high voltages where the mechanical switch operates electrical contacts to switch an electrical load from one high voltage source to another.

Communication systems having a high reliability requirement may use redundant power or voltage sources wherein one voltage source may be used to replace another voltage source for the purposes of source failure protection and servicing and maintenance of the voltage sources. A typical communication system utilizing redundant high voltage sources is the long distance undersea submarine cable used to provide communication links from one continent to another. The repeater circuits of the submarine cable are powered by the high voltage power sources. At least two high voltage sources are selectively connected to each terminal of the cable so that a main high voltage source is backed up by a redundant high voltage source. A transfer switch is utilized to replace one high voltage source with another. The switching arrangement must accommodate high voltages. In the case of communication transmission facilities the redundant voltage source is connected to the load before the primary voltage source is disconnected to assure continuity of transmission service.

A transfer switch which switches high voltage power must be designed to minimize corona. The transfer switching action must be positive and reliable. The personnel operating the switch must be protected from the high voltage sources by insulation.

A high voltage transfer switch should, in addition to the foregoing features, also act smoothly and be of economical construction without compromising the desired performance.

In the powering of communication systems the transfer switch should transfer the load from one high voltage source to another without introducing service interruptions into the cable transmission system.

SUMMARY OF THE INVENTION

The disclosed embodiment of the invention operates to transfer a high voltage energized electrical load from one high voltage source to another high voltage source.

This embodiment of the invention, in addition, transfers the load from one source to another with a controlled overlap wherein the two high voltage sources are momentarily connected in parallel so that power is continuously supplied to the load without interruption.

This disclosed embodiment, in addition, operates reliably and with minimum corona discharge.

The disclosed embodiment also safely isolates the operator from the high voltage power.

Therefore, in accordance with a disclosed embodiment of the invention, a high voltage system with at least two sources of high voltage power includes a mechanical transfer switch to selectively couple one or the other of the high voltage sources to an electrical load to be energized, such as an undersea submarine transmission cable. The mechanical transfer switch operates to open and close electrical contacts to effect a transfer of the load from one high voltage source to another.

The mechanical switch includes a rotatable shaft connected to a handle. Spaced close to the opposite ends of the shaft and connected thereon are two cam wheels, each having slotted type cam surfaces cut therein. Each cam wheel has two cam slot surfaces which are located on the opposite half circles of the cam wheel and each have an arc extent of less than 180°. Cam followers are inserted in each of the cam slots. Each pair of cam followers responsive to a particular cam slot of one half circle side of the cam wheel pair is coupled to the opposite ends of a connecting or follower bar constructed of nonconducting material. The follower bars are constrained by guideways to move linearly. The two follower bars coupled to the two pairs of cam followers are each coupled to a pair of electrical contacts or, in the particular embodiment disclosed, to a pair of mechanical vacuum interrupter contacts. The vacuum interrupter contacts are particularly suited for very high voltage apparatus since the contacts operate in a vacuum. The transfer switch is constructed so that as a cam wheel is rotated the contacts connecting one high voltage supply to the submarine cable are closed and as the cam wheel is continued to be rotated the contacts connecting the second high voltage supply to the submarine cable are subsequently released. This overlapping connect and disconnect sequence is accomplished by coordinating the two cam slot profiles in the opposite half circles of the cam wheels to cause a positive displacement motion of one follower bar in response to cam wheel rotation to close one set of contacts while the oppositely situated follower bar coupled to the presently closed contacts is not moved in response to the initial rotation. As the cam wheel is continued to be rotated, the oppositely situated follower bar is negatively displaced to open the closed set of contacts after the previously open sets of contacts controlled by the first follower bar have been closed or engaged.

BRIEF DESCRIPTION OF THE DRAWING

A transfer switch embodiment utilizing the principles of the invention is described hereinbelow and disclosed in the accompanying drawing wherein:

FIG. 1 is a block diagram of a high voltage system utilizing a transfer switch in accordance with the principles of the invention;

FIG. 2 is a three-dimensional view of a mechanical transfer switch utilizing the principles of the invention;

DETAILED DESCRIPTION

Figure 3:
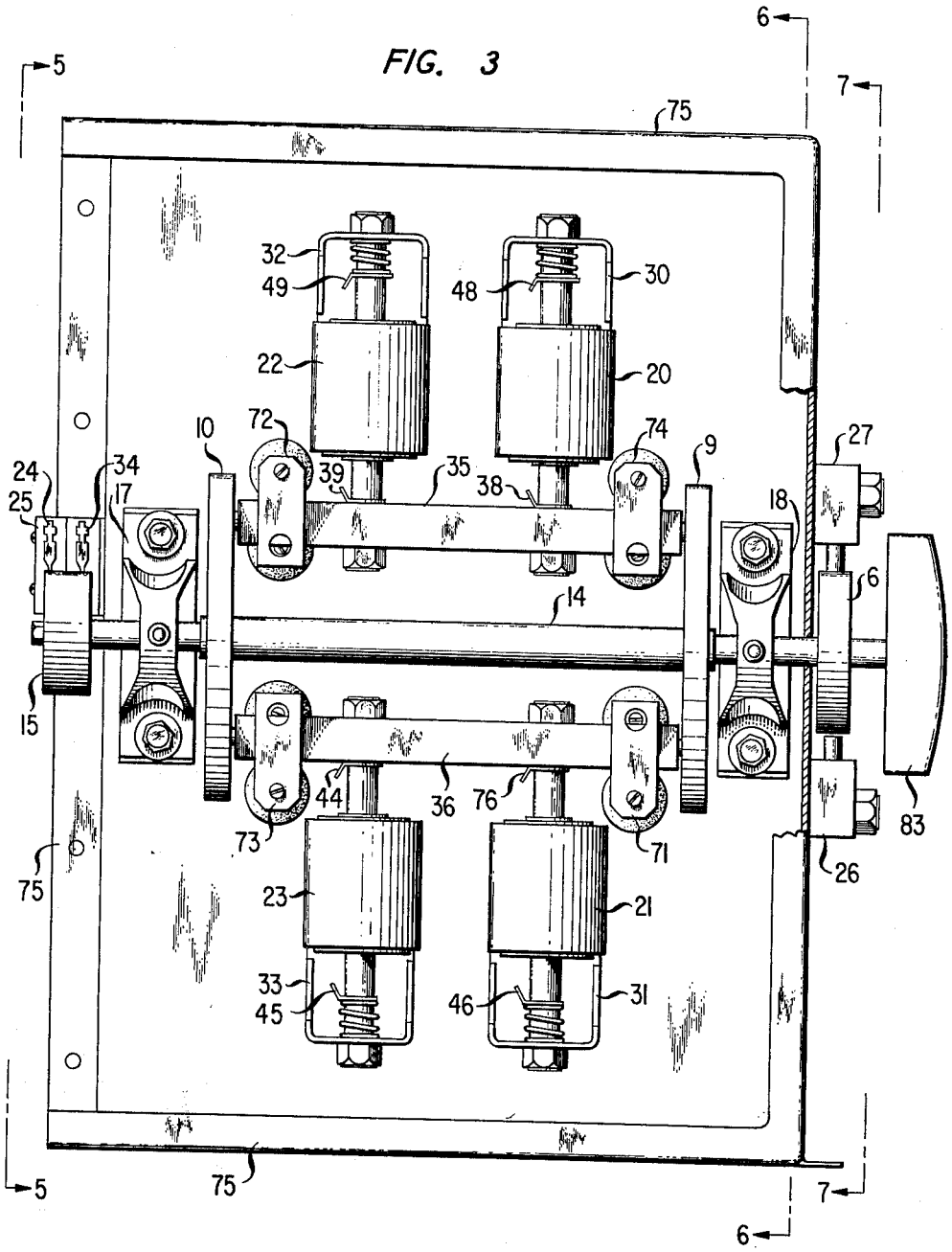
FIG. 3 is a plan view of a mechanical transfer switch utilizing the principles of the invention.

FIG. 1 discloses an electrical system wherein first and second high voltage sources are used to power a submarine cable transmission system. Disclosed in FIG. 1 are a primary high voltage source 51 and a secondary high voltage source 52. The high voltage power sources 51 and 52 in the illustrative embodiment generate a high output voltage which may attain 7500 volts. Each high voltage source may comprise an inverter-rectifier combination. The output of each of the high voltage sources 51 and 52 is electrically coupled to a mechanical transfer switch 53 in which two pairs of electrical contacts are shown connected in a bridge configuration. The pair of contacts 531 and 532 and the pair of contacts 533 and 534 are each mechanically coupled to open and close in unison, respectively. One pair of mechanically coupled contacts 531 and 532 is shown in an open condition while the opposite pair of mechanically coupled contacts 533 and 534 is shown in the closed condition. By rotating the handle 535, the contacts 531 and 532 are initially closed, and as the handle is continually rotated, the contacts 533 and 534 are subsequently opened.

It is apparent from viewing the schematically illustrated electrical connections that the transfer switch alternately couples the primary voltage source 51 and the secondary voltage source 52 to a power separation filter 54 and to a test load impedance 536. The contacts 531, 532, 533, and 534 are interlocked mechanically, as described below, so that each of the high voltage sources 51 and 52 can be connected to the power separation filter 54 and the test load 536. Also note that both of the high voltage sources 51 and 52 are connected in parallel to the power separation filter 54 during the changeover from one high voltage source to another.

Communication signals are applied from the terminal 55 and the lead 56 to the power separation filter 54. The power separation filter 54 combines the transmission signals and the high voltage power signals supplied by the high voltage sources 51 and 52 and applies them to the undersea cable, via lead 57. The high voltage is utilized to power the signal repeaters distributed along the length of the cable.

A three-dimensional view from the rear and top of the mechanical transfer switch is shown in FIG. 2. The mechanical transfer switch components are shown connected to a steel chassis 75. Central to the transfer switch is a rotatable shaft 14 which may be constructed of steel. The shaft is supported by bearings mounted in pillow blocks located close to either end of the shaft 14. The rear end of the shaft 14 is supported by a bearing mounted in the pillow block 17. This bearing may comprise a plain or sleeve type bearing of sufficient strength to support the displacement forces generated by operation of the transfer switch as described below. The bearing may be of a simple grease-lubricated by compression cup type since the rotation of the shaft 14 is infrequent and is always less than 180° of rotation. The shaft 14 preferably includes circumferential grooves located near the bearings into which thrust collars may be inserted in order to prevent linear drift of the shaft 14 along its axis with respect to the bearing locations. The main characteristics required of the bearings are sturdiness and rigidity to hold the rotatable shaft 14 in place. The front bearing and pillow block are not observable in the view shown in FIG. 2. The pillow block 17 containing the rear bearing shown is mounted on a supporting block 47. The front bearing, not shown, is constructed in the same manner and mounted in the same way. The pillow blocks and supporting blocks may be constructed of steel or any other material of sufficient mechanical strength to support the shaft 14.

Connected to the front end of the shaft 14 is a handle 83 through which rotational forces may be applied to the shaft by an operator. At either end of the shaft 14 and close to the bearings are two cam wheels 9 and 10. The cam wheel 9 is close to the front of the transfer switch and is located to the rear of the front bearing and pillow block not shown in FIG. 2. The cam wheel 10 is positioned close to the rear of the transfer switch and is located in front of the rear bearing and pillow block 17. The two cam wheels 9 and 10 are positively connected to the shaft 14 so that they do not slide along the shaft parallel to the axis of the shaft, and do not rotate with respect to the shaft. In the illustrative embodiment the objective is obtained by the use of thrust collars and cut shoulders in the shaft, and by the use of keys. It is readily apparent to those skilled in the art that the ends of the shaft 14 may be turned down in diameter so that the cam wheels 9 and 10 may abut against the shoulders created by the greater diameter of the central portion of the shaft 14. Circumferential grooves are cut in the turned-down portion of the shaft 14 at a distance from the shoulder equal to the thickness of the cam wheel. A thrust collar is inserted in the groove to retain the cam wheel against the shoulder created on the shaft 14. A key slot is cut into the shaft 14 and keyways are cut into the cam wheels 9 and 10. A key is inserted in the shaft 14 to prevent the cam wheels 9 and 10 from rotating with respect to the shaft 14. In the illustrative embodiment a Woodruff key is utilized.

While a specific method of connecting the cam wheels to the shaft has been described, it is to be understood that this is merely suggestive and is not intended to limit the scope of the invention. Depending upon the load requirements, other connecting methods such as cotter pins or set screws may be suitable. Since these techniques are well known in the art, it is not believed necessary to diagrammatically show them in detail.

An eccentric cam 15, constructed of steel, is shown connected to the rear of the shaft 14. The eccentric cam 15 is utilized to indicate the rotational position of the shaft 14 by operating the switching levers 24 and 34 of a microswitch 25. Since the linear forces on the eccentric cam 15 are low, it may be affixed to the shaft by means of a screw screwed into the end of the shaft. The relative rotation between the shaft 14 and the eccentric cam 15 is prevented by milling a flat on the end of the shaft and constructing a hole in the eccentric having a corresponding flat. This hole may be cut by broaching techniques which are well known to those skilled in the art. The microswitch 25 is electrically connected to operate indicator circuitry, which is not shown, to indicate to an operator the particular rotational position to which the cam wheels 9 and 10 are rotated.

The cam wheels 9 and 10 are constructed out of steel and have a zinc plate finish. Each of the cam wheels 9 and 10 includes two cam slots cut through the body of the cam wheel. The surface profiles of the two cam slots are selected to be complimentary so that, as the shaft rotates, one slot on one side of the shaft exerts a positive displacement upon a coupled follower while the complementary slot on the other side of the shaft effects a subsequent negative displacement upon its corresponding coupled follower. The exact configuration of the cam slots is discussed below with reference to FIG. 4.

Cam follower rollers 42 and 43 are shown in FIG. 2 inserted in the opposite cam slots of cam wheel 10. These cam follower rollers 42 and 43 preferably comprise cylindrical rollers which may roll upon the inner or outer surface of the cam slot with little or no friction. Cam follower rollers are also inserted in the two slots of the cam wheel 9 but are not visible in the view shown in FIG. 2.

The cam follower rollers are connected on the opposite ends of the follwer bars 35 and 36. The follower bars 35 and 36 are connected to operate the electrical contacts of the transfer switch in response to the linear motion imparted to the follower bars 35 and 36 by the cam wheels 9 and 10. The two follower bars 35 and 36 are made of a nonconducting or insulating material having the requisite mechanical strength to operate the electrical contacts. A suitable material having the necessary mechanical strength and insulative electrical characteristics is a plastic composed of 10 percent glass polycarbonate with halogenated fire retardant. This material has the necessary insulation properties to permit the switching of very high voltages of 7500 volts with no corona.

The motion of the follower bars 35 and 36 in response to the displacement imparted by the cam rollers is constrained to be a linear displacement by the follower guides 71, 72, 73, and 74. The follower guides 71, 72, 73, and 74 in the illustrative example comprise a square slide-type guide with a locking plate on top to secure the follower bar in the guide. The follower guides 71, 72, 73, and 74 are attached to the chassis 75 by the supporting cones 28 which are attached by screws to the follower guide and the chassis, respectively. The supporting cones are preferably made of a material having good compression strength properties.

The follower guides 71 and 73 and 72 and 74 limit the motion of the follower bars 36 and 35, respectively, to a linear displacement. This linear displacement in both instances is parallel to the axis of the conductive plunger contact movement of the vacuum interrupter contacts 20, 21, 22, and 23 of the transfer switch which are described below. The plunger contacts are constructed of a highly conductive material having a low resistance.

The follower bar 35 is connected to the two conductive plungers of the two vacuum interrupter contacts 20 and 22. The follower bar 36 is connected to the two conductive plungers of the two vacuum interrupter contacts 21 and 23. The vacuum interrupter contacts 20, 21, 22, and 23 are each mechanical switches with conductive plunger type contacts which move linearly on a common axis. The plunger contacts are spring loaded and the conducting contact surfaces are opened and closed in a vacuum chamber. In the illustrative example the conducting plungers have screw threads tapped therein and are attached to the follower bars by means of screws. Two terminal lugs 76 and 44 are connected to the conductive plungers of the vacuum interrupters 21 and 23. These terminal lugs have a washer type construction and are secured by the screws securing the conductive plungers to the follower bar 36. Similarly, two terminal lugs 38 and 39 are secured to the conductive plungers of the vacuum interrupter contacts 20 and 22. The outputs of the primary and secondary high voltage sources shown in FIG. 1 are connected to these terminal lugs. A vacuum interrupter contact suitable for use in the invention is manufactured by ITT Jennings at San Jose, Calif., and has the part number RP 155 BN891.

Conductive members on the opposite side of the vacuum interrupter contacts are connected to supporting steel brackets. The conductive members of the vacuum interrupter contacts 20 and 22 are connected to the brackets 30 and 32, respectively. Each of the brackets is mounted on a pair of cone supports 29 which are connected to the chassis 75. The cone supports 29 are preferably made of an insulative material having the necessary mechanical strength to support the loads to which the bracket is subjected. A suitable material is the above-described polycarbonate. The conductive members of the vacuum interrupter contacts 20 and 22 are connected to the brackets 30 and 32, via a spring loading arrangement and a shoulder screw which eases the tolerance requirements in defining the dimensions and location of the brackets. An identical arrangement is used in the connection of the conductive members of the vacuum interrupters 21 and 23 to the brackets 31 and 33. Spring loading a connecting shoulder screw to ease dimensional tolerances is well known in the art and it is not believed necessary to describe the arrangement in detail.

Two terminal lugs 48 and 49 are connected by the shoulder screws to the conductive members of the vacuum interrupter contacts 20 and 22 which in turn are connected to the supporting brackets 30 and 32. Similarly, two terminal lugs 45 and 46 are connected in the same manner to the conductive members of the vacuum interrupter contacts 21 and 23 which are in turn connected to the supporting brackets 31 and 33. The terminal lugs 48, 49, 45, and 46 are secured in the same manner as described above with respect to the securing of the terminal lugs 38, 39, 76, and 44 to the conductive plungers connected to the follower bars. The terminal lugs 45, 46, 48, and 49 are electrically connected to the power separation filter.

By rotating the shaft 14, the contacts of the vacuum interrupter contacts 20 and 22 and 21 and 23 are opened and closed in a controlled complementary fashion. When the shaft 14, as shown in FIG. 2, is in its right-hand rotational position as viewed from the front of the chassis shown in FIG. 2, the contacts inside the vacuum interrupter contacts 21 and 23 are closed. Hence, an electrical path is completed between the terminal lugs 76 and 46 and between the terminal lugs 44 and 45, respectively. Similarly, the contacts in the vacuum interrupter contacts 20 and 22 are open and there is an open circuit between the terminal lugs 38 and 48 and between the terminal lugs 39 and 49. If the handle 83 is rotated to the full left position, as viewed from the front of the chassis 75, the contacts in the vacuum interrupter contacts 21 and 23 are disengaged and the contacts in the vacuum interrupter contacts 20 and 22 are closed.

A top view of the transfer switch is shown in FIG. 3. FIG. 3 has several cross-section marks designated 5, 6, and 7 to indicate cross-sectional views which are shown respectively in FIGS. 5, 6, and 7 and described hereinbelow. The rotatable shaft 14 is shown mounted in a front bearing in the pillow block 18 and a rear bearing in the pillow block 17. A handle 83 is connected to the front end of the shaft 14 to effect the rotation thereof. A locking cam 6 is shown connected to the shaft between the handle 83 and the pillow block 18. The locking cam 6 in the illustrative embodiment is constructed of steel and is fixed to the shaft 14 by means of a key slot arrangement. In the cam 6 are two locking slots which may be seen in FIG. 7 and into which the plungers of the lock mechanism 26 and 27 may be inserted. The purpose of the locking mechanism is to permit the locking of the transfer switch into a selected position.

At the rear of the shaft 14 is connected the eccentric 15 which, as described above, operates the switch levers 24 and 34 of the microswitch 25.

The cam wheels 9 and 10 which control the linear displacement of the follower bars 35 and 36 are connected to the shaft 14 near its supporting bearings at the opposite ends. The linear motion of the follower bar 35 is controlled by the follower guides 72 and 74 and the linear motion of the follower bar 36 is controlled by the follower guides 71 and 73. The linear motion of the follower bar 35 controls the closing of the contacts of the vacuum interrupter contacts 20 and 22 and the linear motion of the follower bar 36 controls the closing of the contacts of the vacuum interrupter contacts 21 and 23.

Figure 4:
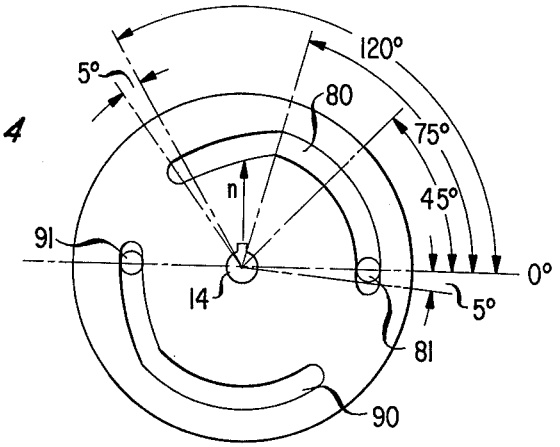
FIG. 4 is a view of the cam wheel to be used in the mechanical switch of FIGS. 2 and 3.

The details of one of the cam wheels is shown in FIG. 4. The cam wheel shown therein includes two cam slots designated 80 and 90. Each of the cam slots in the illustrative embodiment has an arc length which is approximately 130° in circumferential extent. Five degrees of arc length are located at each end of the shaft to be used as rest locations for the cam follower rollers. The profiles of the cam slots are designed to be complementary so that as the cams are rotated the linear displacement imparted to a follower roller is positive in one slot and subsequently negative in the complementary slot. That is, during rotation of the cam wheel from one end position to another, one set of contacts is engaged while the other set of contacts is subsequently disengaged. For example, consider the rollers 81 and 91 as shown in the slots 80 and 90 in FIG. 4. As the cam wheel is rotated in a clockwise direction for approximately 75° beyond the initial 5° rest position, the roller 81 remains stationary in linear direction for the profile of the slot 80 is at a constant radius for this arc of 75°. The contacts responsive to the roller follower 81 remain closed. However, beyond the arc of 75° the radius of the cam slot profile decreases and the roller 81 is linearly displaced towards the rotating shaft 14 supporting the cam. After the cam wheel has been rotated at least 120° as shown in FIG. 4, the roller 81 has been linearly displaced sufficiently to open the contacts of the vacuum interrupter contacts connected thereto. The roller follower 91 in contrast at the beginning of the rotation described above is located in the minimum radius portion of the cam slot profile of the cam slot 90 and holds the contacts responsive to it open. As the cam is rotated in a clockwise direction, the roller follower 91 is immediately displaced in a positive direction, or outward from the shaft 14 within the first 45° of rotation, and operates to close the contacts of the vacuum interrupter contacts responsive to it. As is apparent from the drawing of the cam slot profiles, the initial portion of the cam slot profile of the cam slot 90 has a definite positive displacement for the initial 45° of rotation beyond the 5° rest position. The remaining 75° of the profile of the cam slot 90 wherein the electrical contacts are engaged is at a constant radius from the center of the shaft 14. Hence, it is apparent that during rotation the one cam profile 90 exerts an increasing linear displacement on its roller follower 91 while the complementary cam profile 80 does not exhibit such a displacement. Subsequently, as the cam continues to be rotated, there is an overlapping period wherein the electrical contacts in the vacuum interrupter contacts responsive to the rollers 91 and 81 are both engaged. This overlapping period corresponds to the angular displacement shown in the drawing between 45° and 75°. This overlap is utilized to prevent undesirable switching transients when a transfer is made from one power supply to another.

In the illustrative embodiment the profile of slots is defined by the linear dimension of a radius vector, designated 77, whose linear dimensions is a function of its angular rotation as shown by the tables disclosed herein which are:

| DISTANCE OF SLOT FROM CENTER OF CAM WHEEL | | | |
|---|---|---|---|
| SLOT 80 | | SLOT 90 | |
| ARC | RADIUS | ARC | RADIUS |
| 0°–75° | 2.320 R | 180° | 2.000 R |
| 80° | 2.285 R | 185° | 2.036 R |
| 85° | 2.249 R | 190° | 2.071 R |
| 90° | 2.214 R | 195° | 2.107 R |
| 95° | 2.178 R | 200° | 2.142 R |
| 100° | 2.142 R | 205° | 2.178 R |
| 105° | 2.107 R | 210° | 2.214 R |
| 110° | 2.071 R | 215° | 2.249 R |
| 115° | 2.036 R | 220° | 2.285 R |
| 120° | 2.000 R | 225°–300° | 2.320 R |

R is a basic unit length of radius vector 77 shown in FIG. 4.

Figure 5:
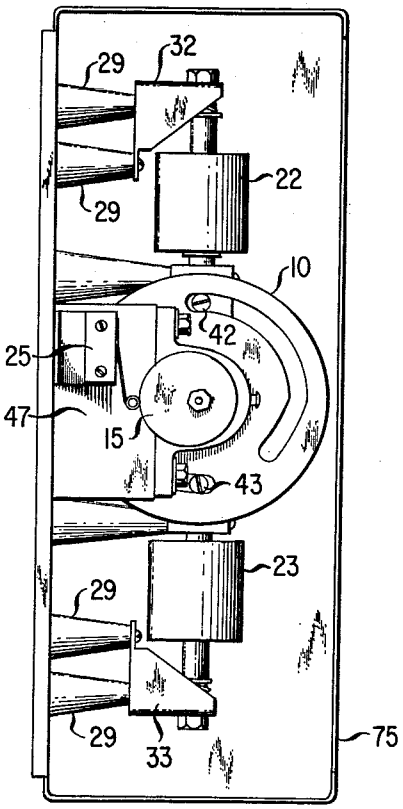

FIG. 5 shows the cross section 5 defined in FIG. 3 which shows a view of the rear of the transfer switch. As can be seen, the interrupter support brackets 32 and 33 are mounted on support cones 29 attached to the chassis 75. The vacuum interrupter contacts 20, 21, 22 and 23 are responsive to the roller followers 42 and 43 which are inserted in the two complementary cam slots of the cam wheel 10. The eccentric cam 15 is located at the end of the shaft and operates the microswitch 25.

Figure 6:
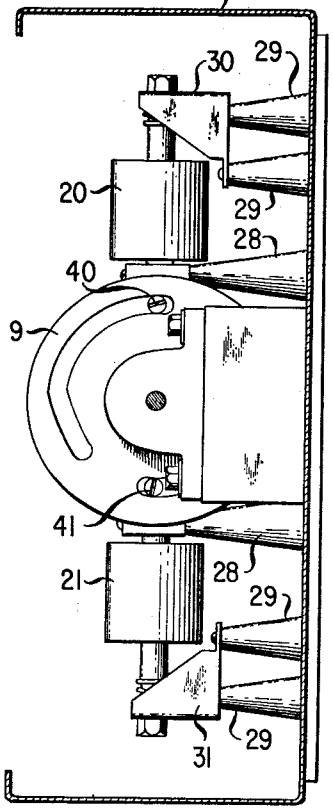

The cross section 6 shown in FIG. 6 shows the front cam wheel 9 which controls the two roller followers 41 and 40 to operate the vacuum interrupter contacts 20, 21, 22, and 23, respectively. The vacuum interrupter contacts 20 and 21 are shown supported by the interrupter support brackets 31 and 30 which are both mounted on the chassis 75 by the insulated cone supports 29. The follower guides controlling the motion of the follower bars are mounted on cone supports 28.

Figure 7:
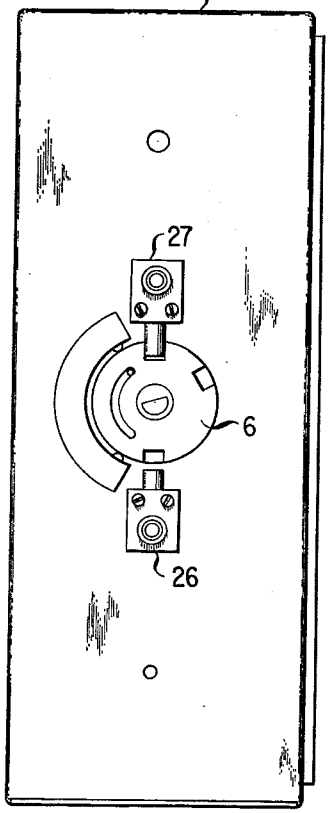
FIGS. 5, 6, and 7 are selected cross-sectional views of the transfer switch as shown in FIG. 3.

FIG. 7 shows the cross section 7 of FIG. 3 and details of the locking cam 6. The locking cam 6 is mounted near the end of the shaft 14. The two locking mechanisms 26 and 27 include plungers which, through the operation of a key, may be inserted into slots in the locking cam 6 as shown to prevent rotation of the shaft 14.

What is claimed is:

1. A transfer switch to selectively couple output terminal means to accept a load to first and second input terminal means to accept a first and second high voltage power source respectively comprising first electric contact means to interconnect said first input terminal means to said output terminal means, second electrical contact means to interconnect said second input terminal means to said output terminal means, means to operate said first and second electrical contact means including cam wheel means, rotatable shaft means to support said cam wheel means, said cam wheel means including first and second cam slots, first and second cam follower means engaged with said first and second cam slots, respectively, constraining means to constrain said first and second cam follower means to have linear motion, said first and second cam follower means connected to impart the motion of said first and second cam follower means to operate said first and second electrical contact means, said first and second cam slots having coordinated profiles so that said first and second follower bars are linearly displaced in sequence whereby one of said first and second electrical switches is engaged before the other of said electrical switches is subsequently disengaged.

2. A transfer switch as defined in claim 1 wherein said cam wheel means comprises first and second cam wheels mounted close to opposite ends of said rotatable shaft means and each of said cam wheels having the first and second cam slots, said first cam follower means comprising a first follower bar of nonconductive material and including roller followers at each end which are inserted into the first cam slot of said first and second cam wheels, and said second cam follower means comprises a second follower bar of nonconductive material and includes roller followers at each end which are inserted into the second cam slot of said first and second cam wheels.

3. A transfer switch as defined in claim 2 wherein said constraining means comprises a first pair of guide ways connected to opposite ends of said first follower bar and a second pair of guide ways connected to opposite ends of said second follower bar.

4. A transfer switch as defined in claim 3 wherein said first electrical contact means comprises a first and second vacuum interrupter contact type switch connected to respond to a linear displacement of said first follower bar and said second electrical contact means comprises a third and fourth vacuum interrupter contact type switch connected to respond to a linear displacement of said second follower bar.

5. A transfer switch arrangement to selectively couple first and second input terminal means to accept a high voltage source to output terminal means to accept a load to be energized comprising, cam means including at least a cam wheel having first and second cam slots therein, a rotatable shaft to support said cam wheel, follower means including first and second follower bars having first and second cam followers engaged with said first and second cam slots, respectively, follower bar constraint means to constrain said follower bars to linear motion, and first and second electrical contact means responsive to a linear displacement of said first and second follower bars to interconnect said first and second input terminal means to said output terminal means, said first cam slot having a first cam profile whereby a first rotation of said shaft causes said first electrical contact to open, said second cam slot having a second cam profile complementary to said first cam profile whereby said first rotation of said shaft causes said second electrical contact to close before said first electrical contact opens, and a rotation of said shaft opposite said first rotation causes said second electrical contact to open and said first electrical contact to close before said second electrical contact opens.

6. A transfer switch as defined in claim 5 wherein said first cam slot profile encompasses an arc of at least from 0° to 120° wherein the radial extent of said first cam slot profile is uniform for an arc of 0° to 75° and decreases in magnitude for an arc from 75° to 120° and said second cam slot profile encompasses an arc of at least from 300° to 180° wherein the radial extent of said second cam slot profile is uniform for an arc of 300° to 225° and decreases in magnitude for an arc of 225° to 180°.

7. A transfer switch to selectively couple first and second input means to accept a high voltage source to output means to accept a load comprising cam wheel means including, first and second cam slots in opposite halves of the cam wheel means, rotatable shaft means to support said cam wheel means, first and second cam follower means mechanically coupled to said first and second cam slots, respectively, guide means to limit said first and second cam followers to linear motion and first and second electrical contact means responsive to a linear displacement of said first and second cam follower means, said first and second electrical contact means electrically coupling said first and second input means to said output means, respectively, said first cam slot having a first cam surface profile to linearly displace said first cam follower for a defined arc of rotation of said cam wheel means, said second cam slot having a second cam surface profile to linearly displace said second cam follower for a defined arc of rotation of said cam wheel means, said first and second cam profiles coordinated to affect said linear displacements of said first and second cam follower means in sequence.

* * * * *